US009993039B2

(12) United States Patent
Nykoluk et al.

(10) Patent No.: US 9,993,039 B2
(45) Date of Patent: Jun. 12, 2018

(54) GARMENT WITH PLATE CARRYING SYSTEM

(71) Applicant: 5.11, Inc., Modesto, CA (US)

(72) Inventors: Cory Owen Nykoluk, Orange, CA (US); Cres Trilles Alcantra, Irvine, CA (US); Fernando Calderon Aguilar, Modesto, CA (US)

(73) Assignee: 5.11, Inc., Modesto, CA (US)

( * ) Notice: Subject to any disclaimer, the term of this patent is extended or adjusted under 35 U.S.C. 154(b) by 111 days.

(21) Appl. No.: 14/922,904

(22) Filed: Oct. 26, 2015

(65) Prior Publication Data

US 2016/0044976 A1 Feb. 18, 2016

Related U.S. Application Data

(63) Continuation-in-part of application No. 14/094,583, filed on Dec. 2, 2013, and a continuation-in-part of application No. 14/656,435, filed on Mar. 12, 2015.
(Continued)

(51) Int. Cl.
*A41D 13/05* (2006.01)
*A41D 13/015* (2006.01)
(Continued)

(52) U.S. Cl.
CPC ..... *A41D 13/0575* (2013.01); *A41D 13/0007* (2013.01); *A41D 13/0153* (2013.01);
(Continued)

(58) Field of Classification Search
CPC . A41S 13/0575; A41D 27/205; A41D 27/207; A41D 13/0562; A41D 13/0568; F41H 1/02
(Continued)

(56) References Cited

U.S. PATENT DOCUMENTS 478,076 A 7/1892 Asten et al.
784,527 A 3/1905 Vernon
(Continued)

FOREIGN PATENT DOCUMENTS

DE 2005119162 A2 12/2005
EP 2476327 A2 7/2012
(Continued)

OTHER PUBLICATIONS

U.S. Appl. No. 14/094,583, "Non-Final Office Action", dated Apr. 18, 2016, 22 pages.
U.S. Appl. No. 14/094,583, "Garment With Carrying System", US Patent Application, filed Dec. 2, 2013.
U.S. Appl. No. 14/454,641, "Hexagonal Attachment System", U.S. Patent Application, filed Aug. 7, 2014.
(Continued)

*Primary Examiner* — Alissa L Hoey
(74) *Attorney, Agent, or Firm* — Kilpatrick Townsend & Stockton LLP

(57) ABSTRACT

A load-bearing garment, such as a vest, is provided having stretchable web platform on an outside surface, such as between front and back panels of the vest. The stretchable web platform includes stretchable bands that extend horizontally, and vertical webbing extending between multiple horizontal bands. Additional embodiments are directed to a mounting system in a plate carrier for a plate. Still further embodiments are directed to a handle and strap system for a vest or other garment that permits a quick rescue of a person wearing the vest.

19 Claims, 9 Drawing Sheets

Related U.S. Application Data

(60) Provisional application No. 61/732,165, filed on Nov. 30, 2012, provisional application No. 61/951,986, filed on Mar. 12, 2014.

(51) Int. Cl.
*A41D 13/00* (2006.01)
*F41H 1/02* (2006.01)

(52) U.S. Cl.
CPC ..... *A41D 13/0562* (2013.01); *A41D 13/0568* (2013.01); *F41H 1/02* (2013.01); *Y10T 428/249921* (2015.04)

(58) Field of Classification Search
USPC ..... 2/102, 2.5
See application file for complete search history.

(56) References Cited

U.S. PATENT DOCUMENTS 1,495,489 A 5/1924 Krause
2,517,615 A 8/1950 Webster et al.
3,000,119 A 9/1961 Altman et al.
3,452,362 A 7/1969 Korolick et al.
3,754,284 A 8/1973 Hartigan et al.
3,973,275 A 8/1976 Blauer
4,041,549 A 8/1977 Atkinson
4,079,464 A 3/1978 Roggin
4,211,218 A 7/1980 Kendrick
4,266,297 A 5/1981 Atkins
4,422,454 A 12/1983 English
4,485,491 A 12/1984 Rasmussen
4,497,069 A * 2/1985 Braunhut ..... F41H 1/02 2/2.5
4,507,802 A 4/1985 Small
4,535,478 A 8/1985 Zuefle
4,593,788 A 6/1986 Miller
4,745,883 A 5/1988 Baggetta
5,027,833 A 7/1991 Calkin
5,060,314 A 10/1991 Lewis
5,072,453 A 12/1991 Widder
5,157,792 A 10/1992 Allen et al.
5,220,976 A 6/1993 Gunter
5,325,538 A 7/1994 Schoenweiss et al.
5,327,811 A 7/1994 Price et al.
5,331,683 A 7/1994 Stone et al.
5,431,318 A 7/1995 Garcia
5,495,620 A 3/1996 Schoenweiss et al.
5,514,019 A 5/1996 Smith
5,531,292 A 7/1996 Bell
5,564,476 A 10/1996 Golz
5,584,737 A 12/1996 Luhtala
5,617,582 A 4/1997 Burwell
5,644,792 A 7/1997 Tishler et al.
5,754,982 A 5/1998 Gainer
5,934,530 A 8/1999 Antczak et al.
5,974,585 A 11/1999 Bachner, Jr.
6,041,444 A 3/2000 McKinney
6,108,816 A 8/2000 Bradley
6,158,642 A 12/2000 Herbage
6,185,738 B1 2/2001 Sidebottom
6,205,584 B1 3/2001 Yocco
6,213,365 B1 4/2001 Stocke et al.
6,233,740 B1 5/2001 Meyers et al.
6,659,689 B1 12/2003 Courtney et al.
6,712,251 B2 3/2004 Godshaw et al.
6,775,846 B1 8/2004 LaFauci et al.
6,800,007 B2 10/2004 Calkin
7,204,468 B2 4/2007 Kintzele et al.
7,240,404 B2 7/2007 Flössner
7,264,023 B2 9/2007 Jackson
7,318,542 B2 1/2008 Godshaw et al.
7,424,748 B1 9/2008 Mcdunn et al.
7,444,686 B2 11/2008 Stewart
7,490,358 B1 2/2009 Beck et al.
7,536,728 B1 5/2009 Leathers
7,596,815 B2 10/2009 Grilliot et al.
7,610,641 B2 11/2009 Frost
7,699,197 B2 4/2010 Panosian et al.
7,712,148 B2 5/2010 Carlson
7,748,053 B1 7/2010 Hancock
7,770,770 B2 8/2010 Murdoch et al.
7,810,167 B2 10/2010 Seitzinger et al.
7,845,527 B1 12/2010 McMillan et al.
7,917,968 B2 4/2011 Roux
8,002,159 B2 8/2011 Cragg
8,011,545 B2 9/2011 Murdoch et al.
8,015,619 B2 9/2011 McKay et al.
8,025,192 B2 9/2011 Petzl et al.
8,079,503 B1 12/2011 Yeates et al.
8,087,560 B2 1/2012 Crye
8,162,365 B2 4/2012 Escobar
8,430,204 B1 4/2013 Reynolds
8,590,116 B2 11/2013 Dahl
8,608,041 B1 12/2013 Adkisson
8,635,714 B2 1/2014 Hazlett
8,776,266 B1 7/2014 Metz
8,826,462 B2 * 9/2014 Storms, Jr. ..... F41H 1/02 2/102
8,898,814 B2 * 12/2014 Storms, Jr. ..... A41D 1/04 2/102
9,114,749 B2 8/2015 Ashliman et al.
9,144,294 B2 9/2015 Gregory et al.
9,441,916 B2 * 9/2016 Seuk ..... F41H 1/02
2003/0146348 A1 8/2003 Douglas et al.
2004/0023574 A1 2/2004 Calkin
2004/0027751 A1 2/2004 Goerke et al.
2005/0179244 A1 8/2005 Schroth
2006/0143763 A1 7/2006 Dawson et al.
2006/0253950 A1 11/2006 Kerr
2006/0288466 A1 12/2006 Bucheit
2007/0044197 A1 3/2007 Turcotte et al.
2007/0192926 A1 8/2007 Fee et al.
2007/0289045 A1 12/2007 Evans et al.
2008/0010730 A1 1/2008 Twito et al.
2008/0256680 A1 10/2008 Peksoz et al.
2008/0289086 A1 11/2008 Grilliot et al.
2009/0117300 A1 5/2009 Thompson
2009/0211000 A1 8/2009 Roux
2009/0282595 A1 11/2009 Branson et al.
2009/0307878 A1 12/2009 Kadas
2009/0320171 A1 12/2009 Kocher et al.
2010/0031415 A1 2/2010 Shadid
2010/0162459 A1 7/2010 Bronstein et al.
2010/0224660 A1 9/2010 Gleason
2010/0313329 A1 12/2010 Haynes
2011/0030118 A1 2/2011 Pratchett
2011/0030119 A1 2/2011 Fee et al.
2011/0055992 A1 3/2011 Roux et al.
2011/0191933 A1 8/2011 Gregory et al.
2011/0284322 A1 11/2011 West
2012/0132065 A1 5/2012 Seuk
2012/0167288 A1 * 7/2012 Chen ..... A62B 17/005 2/458
2012/0180178 A1 * 7/2012 Gallo ..... F41H 1/02 2/2.5
2012/0180189 A1 7/2012 Crye
2012/0192335 A1 8/2012 Crye
2013/0126566 A1 5/2013 Seuk et al.
2013/0240588 A1 9/2013 Milligan et al.
2014/0090145 A1 4/2014 Strum et al.
2014/0150161 A1 6/2014 Nykoluk
2014/0151424 A1 6/2014 Hexels et al.
2014/0201879 A1 * 7/2014 Seuk ..... F41H 1/02 2/2.5
2014/0237698 A1 8/2014 Murphy et al.
2014/0259249 A1 * 9/2014 Milligan ..... F41H 1/02 2/2.5
2014/0263519 A1 9/2014 Saucedo et al.
2015/0157117 A1 6/2015 Seuk et al.
2015/0257458 A1 9/2015 Nykoluk et al.

(56) References Cited

U.S. PATENT DOCUMENTS

| | | | | |
|---|---|---|---|---|
| 2015/0285594 | A1* | 10/2015 | Seuk | F41H 1/02 2/2.5 |
| 2015/0359272 | A1 | 12/2015 | Murphy et al. | |
| 2016/0021941 | A1 | 1/2016 | Jen | |

FOREIGN PATENT DOCUMENTS

| | | | |
|---|---|---|---|
| WO | 0048480 | A2 | 8/2000 |
| WO | 0205678 | A1 | 1/2002 |
| WO | 2006134241 | A1 | 12/2006 |
| WO | 2007079387 | A2 | 7/2007 |
| WO | 2007146797 | A2 | 12/2007 |
| WO | 2008072011 | A1 | 6/2008 |
| WO | 2008073087 | A1 | 6/2008 |
| WO | 2009052769 | A2 | 4/2009 |

OTHER PUBLICATIONS

U.S. Appl. No. 14/656,435, "Attachable Tow Handle Pocket for Garment", U.S. Patent Application, filed Mar. 12, 2015.

U.S. Appl. No. 14/094,583, "Final Office Action," dated Nov. 10, 2016, 14 pages.

U.S. Appl. No. 14/094,583, "Non-Final Office Action," dated Feb. 28, 2017, 12 pages.

U.S. Appl. No. 14/656,435, "Non-Final Office Action," dated May 10, 2017, 20 pages.

U.S. Appl. No. 14/094,583 , "Notice of Allowance", dated Jul. 19, 2017, 8 pages.

* cited by examiner

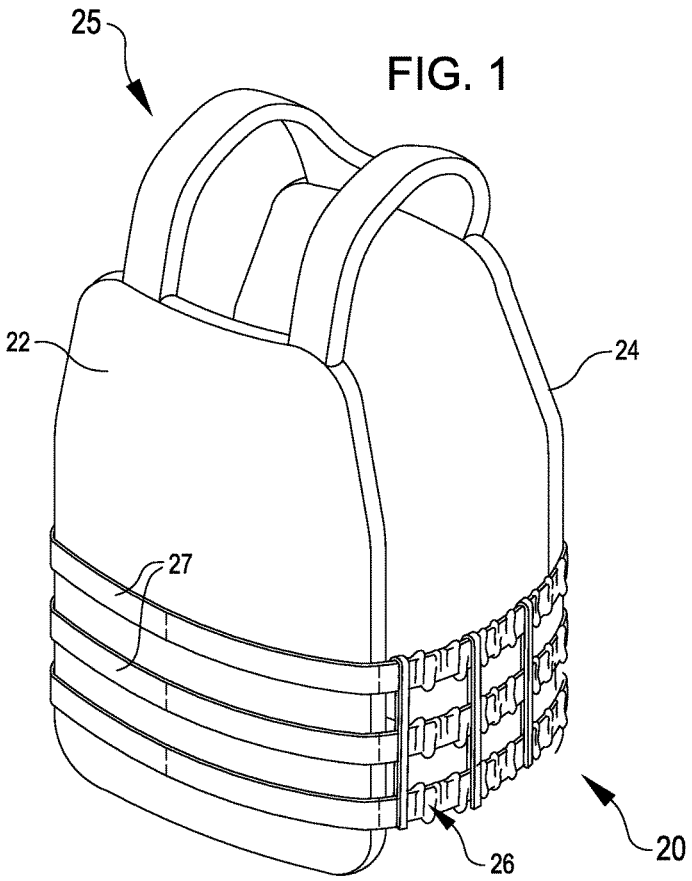
FIG. 1
FIG. 2
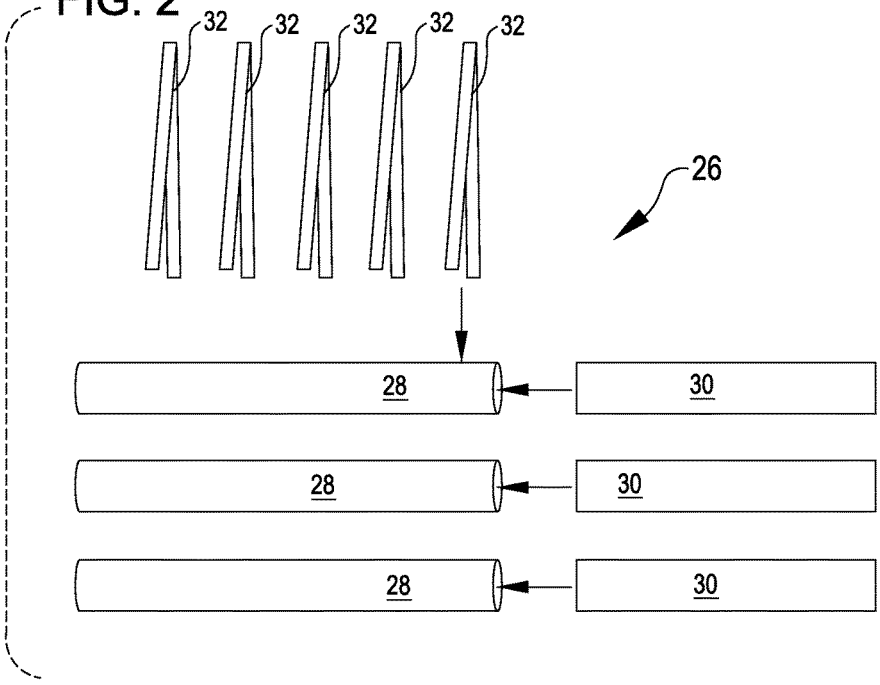

GARMENT WITH PLATE CARRYING SYSTEM

CROSS-REFERENCES TO RELATED APPLICATIONS

This application is a Continuation-in-Part Application of U.S. Non-Provisional patent application Ser. No. 14/094,583, filed Dec. 2, 2013, entitled "GARMENT WITH CARRYING SYSTEM," which claims the benefit of U.S. Provisional Application No. 61/732,165, filed on Nov. 30, 2012, the full disclosures of which are incorporated herein by reference. This application is also a Continuation-in-Part of U.S. Non-Provisional patent application Ser. No. 14/656,435, entitled "ATTACHABLE TOW HANDLE POCKET FOR GARMENT," filed Mar. 12, 2015, which claims the benefit of U.S. Provisional patent application No. 61/951,986, entitled "ATTACHABLE TOW HANDLE POCKET FOR GARMENT," filed Mar. 12, 2014 the full disclosures of which are hereby incorporated herein by reference.

BACKGROUND

MOLLE (Modular Lightweight Load-carrying Equipment) is load-bearing equipment and rucksacks utilized by the United States armed forces. The MOLLE system is modular and permits the attachment of various MOLLE-compatible accessories, such as holsters, magazine pouches, radio pouches, knife sheathes, and other gear to MOLLE compatible load-bearing garments, such as vests, backpacks, and jackets.

The MOLLE system's modularity is derived from the use web platforms on load-bearing garments. For example, PALS (Pouch Attachment Ladder System) web platforms can be included on the load-bearing garments. PALS webbing includes rows of heavy-duty nylon stitched onto the vest or other load-bearing garment so as to allow for attachment of MOLLE accessories.

PALS webbing is attached to load-bearing garments in a grid structure. The PALS grid consists of horizontal rows of 1 inch nylon webbing (most commercial vendors use Type IIIa), spaced 1 inch apart, and reattached, typically via stitching, to the backing at 1.5 inch intervals. This consistent reattachment forms, for each strap, a series of upwardly and downwardly opened loops. The loops for adjacent straps are aligned so that a series of loops are stacked one on top of each other. This pattern provides secure and stable attachment for MOLLE accessories.

The following references may be relevant to this technology: U.S. Published Patent application number 2012/0180189, U.S. Published Patent application number 2012/0132065, U.S. Pat. No. 7,444,686, U.S. Pat. No. 5,431,318, U.S. Pat. No. 7,917,968, and P.C.T. Published Patent application number WO 2005/119162.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with embodiments, a load-bearing garment, such as a vest, is provided having stretchable web platform on an outside surface, such as between front and back panels of the vest. The stretchable web platform includes stretchable bands that extend horizontally, and vertical webbing extending between multiple horizontal bands.

The stretchable bands can be, for example, elastic sleeves that fit within tube webbing, and pull the tube webbing inward.

Gear can be attached either to the horizontal bands or the vertical webbing. The gear can be, for example, MOLLE compatible gear.

Additional embodiments are directed to a mounting system in a plate carrier for a plate. In some arrangements, the mounting system includes two sets of straps, such as webbing, with hook and loop material. The straps can be connected at different points along their length so that plates of various sizes can be accommodated. For each set, one strap extends under the plate and one strap extends around a lower side edge of the plate. The ends are connected by the hook and loop materials. Pulling the ends taunt permits the plate to be firmly held in position, regardless of plate size. The straps may thus respectively act as horizontally-aligning features and vertically-aligning features. In some arrangements, a single flap or strap can be used in place of multiple straps, e.g., for the vertically-aligning features. The aligning features can be secured in an arrangement about the plate by attachment, such as by hook and loop material, with an interior wall of a pocket that receives the plate. Attachment to the wall of the pocket may replace or reinforce attachment of the aligning features to one another.

Still further embodiments are directed to a handle and strap system for a vest or other garment that permits a quick rescue of a person wearing the vest. A handle is attached to a strap and is usually accessible from an outside of the vest, for example just below the back of the base of the neck. The strap can be mounted in a pocket or sleeve in this storage configuration. The handle can be grasped and pulled outward, released for example from hook and loop closures. The strap is pulled outward, but is anchored at a distal end to the vest.

When the handle is pulled out and the strap is pulled taut, the handle can be used to pull and/or drag the wearer of the vest to a safe location. Once used, the strap can be stored again in its sleeve, and the handle can be reattached, if attachments are provided.

For a fuller understanding of the nature and advantages of the present invention, reference should be made to the ensuing detailed description and accompanying drawings.

BRIEF DESCRIPTION OF THE DRAWINGS

Various embodiments in accordance with the present disclosure will be described with reference to the drawings, in which:

FIG. 1 is a side, perspective view of a vest incorporating stretchable web platform in accordance with embodiments.

FIG. 2 is an exploded perspective view of stretchable web platform in accordance with embodiments.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 6:
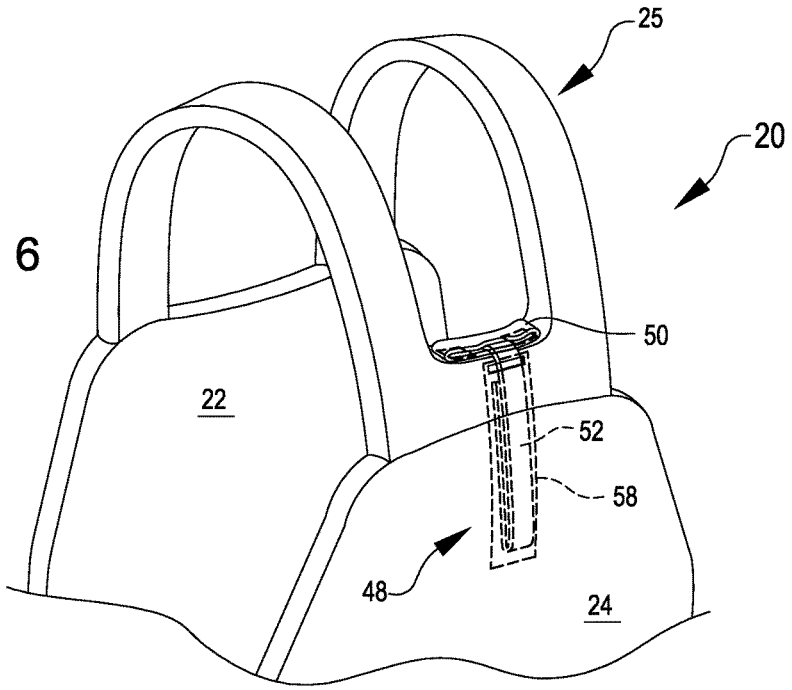
FIG. 6 is a perspective view of a plate carrier vest having a handle and strap system, with the system in a stored configuration.
Figure 7:
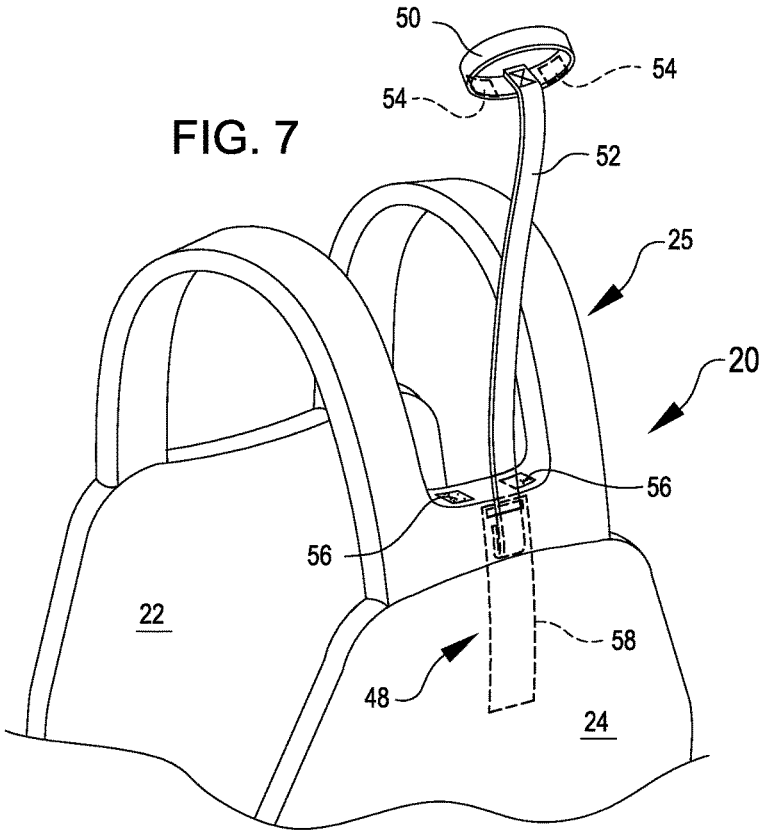
FIG. 7 is a perspective view, similar to FIG. 6, of the plate carrier vest with the handle and strap system in a deployed configuration.

Embodiments herein are directed to mounting systems in a plate carrier. This disclosure additionally includes a description of a stretchable web platform exposed for the attachment of gear (FIGS. 1 to 5), and a handle and strap system integrated into a vest or other garment that permits a quick rescue of a person wearing the vest (FIGS. 6-7).

In accordance with embodiments, a jacket or vest or other garment or other carrier is provided having a stretchable web platform exposed for the attachment of gear, such as MOLLE compatible gear. In embodiments, the stretchable web platform can support gear hung either vertically or horizontally.

For example, in the embodiment shown in FIG. 1, a vest 20 is shown having a front panel 22 and a rear panel 24. A shoulder yoke 25 attaches to the tops of the front and rear panels 22, 24 and connects the two panels. A stretchable web platform 26 extends between a bottom portion of the front panel 22 and the rear panel 24. Specifically, in FIG. 1, the stretchable web platform 26 extends between lower side edges of the front and rear panels. A separate stretchable web platform 26 is positioned on each side of the vest 20, although only the left side is shown in FIG. 1. Webbing material 27 extends from the stretchable web platform 26 and across the front the front panel 22 and the rear (not shown) of the rear panel 24. Thus, the stretchable web platform 26 on each side of the vest 20 and the webbing material 27 on the front and rear panels 22, 24 circumscribe the bottom of the vest. The stretchable web platform 26 permits some elasticity to the connection between the front and rear panels 22, 24, providing a more snug fit of the vest without the vest being too tight.

Although shown as attached between the front and rear panels 22, 24, the stretchable web platform 26 can be attached to other locations, such as across the front or inside either of the panels 22, 24 of the vest 20. To this end, the stretchable web platform 26 can extend over any portion of the outside of the vest 20, or can overlap portions of the inside of the vest. The stretchable web platform 26 can also be mounted on other garments, such as a jacket or pants, or could be used with many different items, including backpacks. The stretchable web platform has particular application, however, to installations where both (1) stretch and elasticity and (2) attachment of gear are desired at the same location.

Details of the stretchable web platform 26 are shown in the exploded perspective view of FIG. 2. The stretchable web platform 26 includes a plurality (e.g., more than two) horizontally-aligned webbing tubes 28. The webbing tubes 28 can be, for example, 1.0 inch tubes of webbing.

Strips 30 of elastic material are inserted in the webbing tubes 28. The elastic strips 30 can be elastic webbing or other material that is stretchable and has a memory to return to its initial shape after stretching. The elastic can be made of rubber or an imitative rubber synthetic material, as examples.

Figure 3:
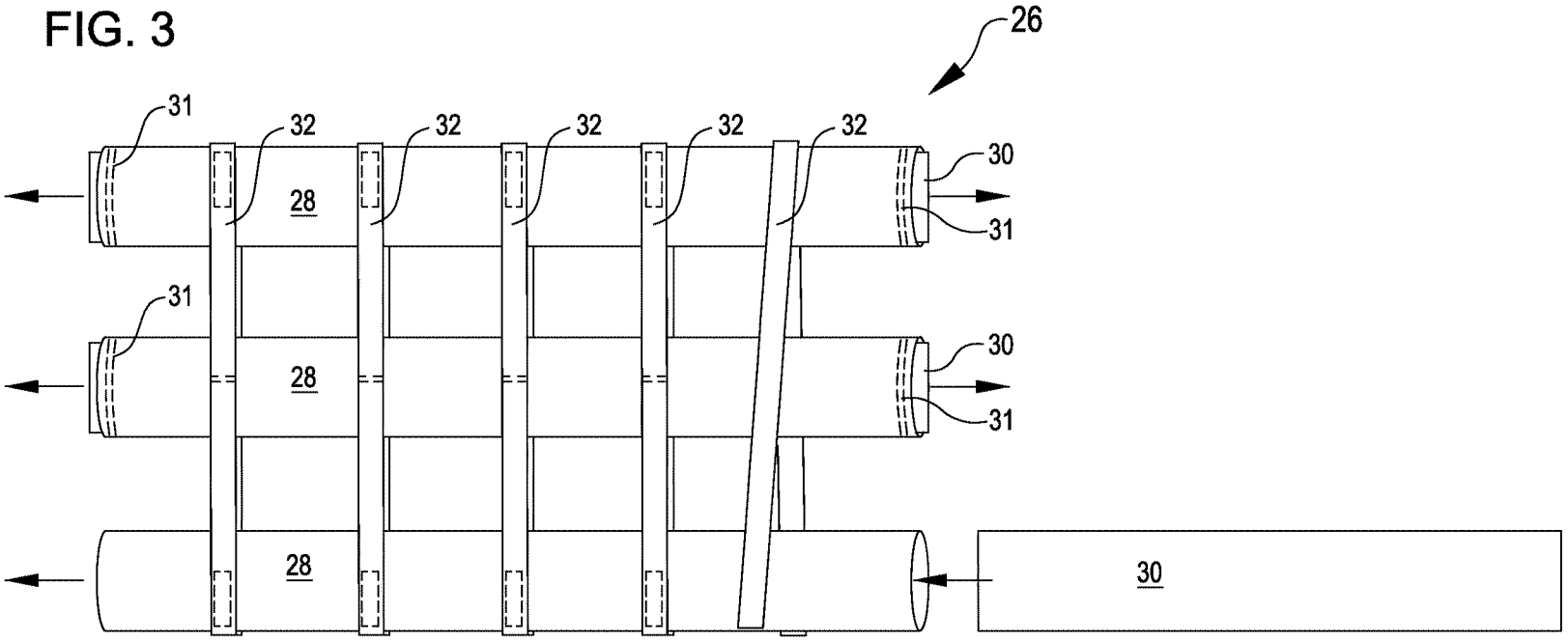
FIG. 3 is a side assembled view of the stretchable web platform of FIG. 2.

The elastic strips 30 are shorter in length than the webbing tubes 28. In embodiments, the elastic strips 30 are ⅔ the length of the webbing tubes 28. As shown in FIG. 3, the ends of the elastic strips 30 are sewn at sew lines 31 to ends of the webbing tubes 28. Sewing the elastic strips 30 to the ends of the webbing tubes 28 causes the webbing tubes to compress and fold to the length of the elastic straps. The webbing tubes 28 can include a number of folds or wrinkles during this compression.

The compressed webbing tubes 28 and the elastic strips 30, once sewn together, provide a stable structure to which gear, such as MOLLE compatible gear, can be attached. The outer webbing tubes 28 provide a surface that is similar to regular webbing, and thus is suitable for the attachment of gear. The compressed/folded/wrinkled configuration of the web tubing 28, along with the elastic strips 30, permits the overall structure of the stretchable web platform 26 to be stretchable in a horizontal direction, allowing the vest 20 to fit snugly, but not too tightly, against a wearer, and to adjust to movements of a wearer, adding to comfort to the wearer.

Vertical webbing 32 (FIG. 2) can be attached between multiple webbing tubes 28. The vertical webbing 32 can be any width, but in embodiments is 0.25 inch webbing. The vertical webbing 32 is sewn to the web tubing 28, and can also be sewn through the web tubing to the elastic strips 30. In embodiments, however, the vertical webbing 32 is sewn only to the web tubing 28, allowing the elastic strips 30 to freely move within the web tubing 28.

Figure 4:
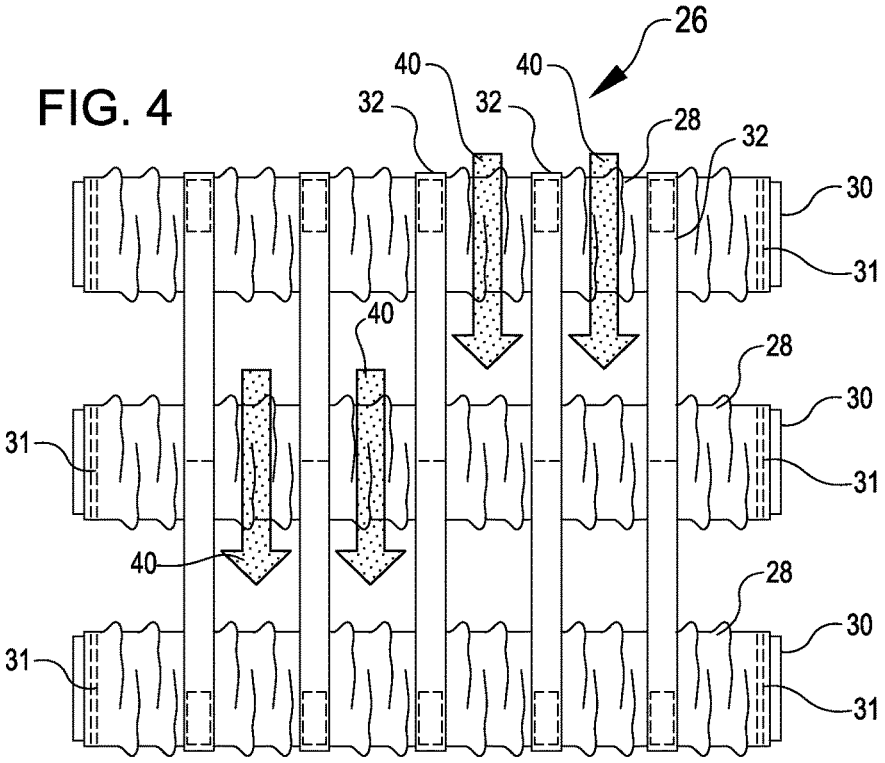
FIG. 4 is a side view, similar to FIG. 3, of the stretchable web platform of FIG. 2, showing vertical mount options for the stretchable web platform.

As shown in FIG. 4, the stretchable web platform 26 can receive and support gear, such as MOLLE compatible gear, mounted vertically, as shown by the arrows 40. The gear mounts down over one or two of the horizontally aligned web tubings 28. The gear can attach, for example, between vertical webbings 32 or on opposite sides of a vertical webbing.

Figure 5:
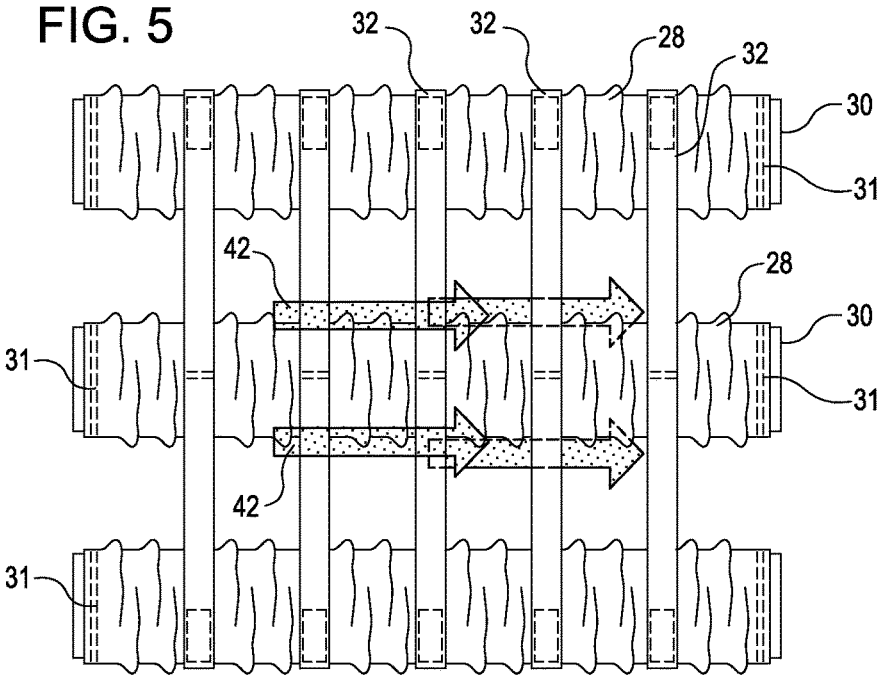
FIG. 5 is a side view, similar to FIG. 4, of the stretchable web platform of FIG. 2, showing horizontal mount options for the stretchable web platform.

As shown in FIG. 5, the stretchable web platform 26 can also receive and support gear, such as MOLLE compatible gear, mounted horizontally, as shown by the arrows 42. The gear mounts sideways, attached to one or more of the vertical webbings 32. The gear can attach, for example, between adjacent horizontally aligned web tubings 28 or on opposite sides of a horizontally aligned web tubing.

FIG. 6 shows another feature that can be provided for the vest 20. In FIG. 6, a handle and strap system 48 is shown mounted on the rear of the vest 20. The handle and strap system 48 permits a quick rescue of a person wearing the vest or other garment. Briefly described, the handle and strap system 48 is mounted in a storage position against and/or within the vest 20 (FIG. 6), and can be pulled outward to a deployed position where it can be used to drag a wearer of the vest to a safe location (FIG. 7). A handle 50 is attached to a strap 52 and mounted in a storage configuration where the handle is accessible from an outside of the vest, for example just below the back of the base of the neck.

In the storage position, fasteners or other connectors, such as hook and loop closures 54, 56, can be used to hold the handle in position. Hook and loop closures 54, 56 work well to connect the handle, because the closures can be released and the handle and strap deployed using a single movement (i.e., pulling outward on the handle). However, other closures can be used, or the handle can be held in position by gravity and/or retention of the strap 52. Closures could also or alternatively be used to retain the strap.

In the embodiment shown in the drawing, the handle 50 is formed of a loop of webbing. The strap 52 is attached to one position on the loop, and the closures 54 are positioned on opposite sides of the strap attachment. The closures 54 connect to closures 56 when the handle is in the storage position.

In embodiments, the strap 52 is positioned in a sleeve 58 or other pocket while the handle and strap system 48 is in the storage configuration. The sleeve 58 permits the strap 52 to be out of the way while the handle and strap system 48 is in the storage position, but easily deployed when needed. The sleeve 58 shown in the drawings extends in a direction of deployment so that the sleeve does not hinder deployment. A distal end of the strap 52 is anchored to the vest 20, for example at the opening of the sleeve 58.

In use, when a wearer of the vest 20 is to be rescued, the wearer is extended in a prone position, and the rescuer grasps the handle and pulls outward in a direction, first releasing the hook and loop closures 54, 56, and then pulling the strap 52 from the sleeve 58. The strap 52 is pulled taut against its anchor at an opening of the sleeve 58, such as is shown in FIG. 7. Continued pulling on the handle 50 permits the rescuer to drag the wearer to safety. The vest 20 retains the wearer during this rescue, and the strap can readily take advantage of the fact that the wearer is fully connected.

Once used, the strap 52 can be stored again in its sleeve 58, and the handle 50 can be reattached via the hook and loop closures 54, 56.

Figure 8:
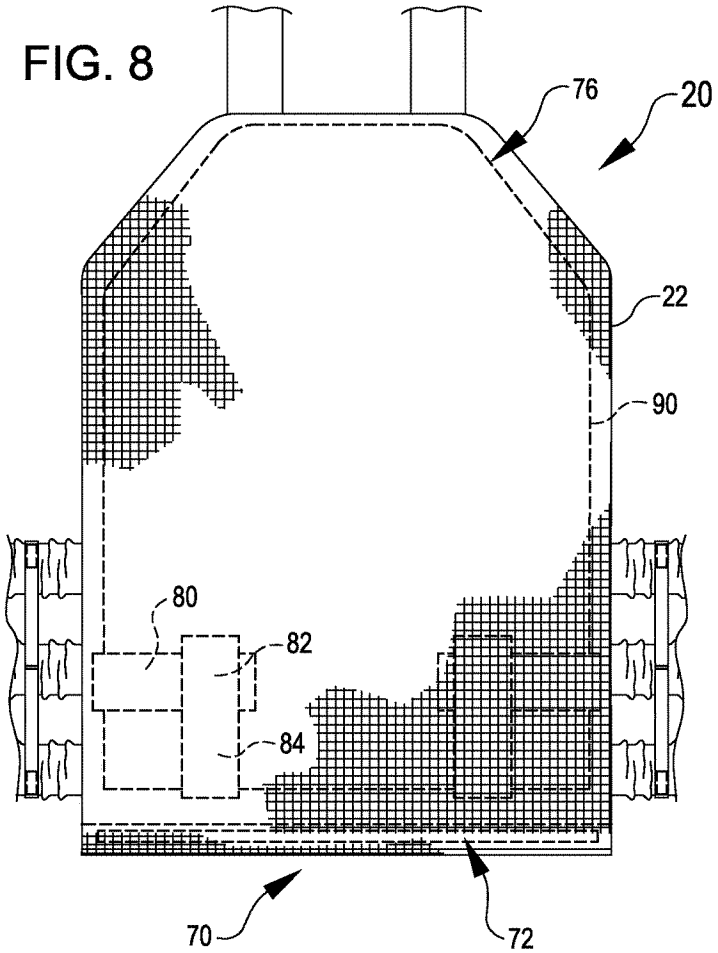
FIG. 8 is a rear view of a front panel of a plate carrier vest showing a plate carrier retention system in accordance with embodiments.

FIGS. 8-11 show a plate retention system 70 for a vest or other carrier, such as the vest 20, in accordance with embodiments. The plate retention system 70 can be utilized, for example, in pockets on the front and/or back panels 22, 24 of the vest 20. Such pockets are known, and typically include an opening, such as an opening 72 at the bottom of the front panel 22 (FIG. 8). In the embodiment shown in the drawing, the opening 72 can include a closure 74, such as hook and loop closures, for easy access. The pocket is generally designated by the reference numeral 76, and is generally the inside region of a panel, such as the front panel 22, designed to receive a plate (such as a ballistic plate for providing protection against bullets or other projectiles).

Although illustrated relative to the vest 20, the plate retention system 70 can alternatively be utilized in carriers other than vests, such as with garments, harnesses, or other structures that can be worn or otherwise used to secure one or more pockets to any suitable portion of a body of a wearer, including but not limited to parts or all of the torso, a limb, or other portion of the wearer's body. For example, a pocket may be coupled with a carrier so as to be located along the body of a wearer when the carrier is worn by the wearer. Features associated with the pocket may be oriented relative to a vertical direction generally aligned with a direction of gravity when the carrier is worn by the wearer when the wearer is in an upright position and a horizontal direction generally transverse to the vertical direction. Further, portions of a particular feature may be oriented relative to a wearer in an upright position, such as a top or upper direction being closest to or toward the head of the upright wearer, a bottom or lower direction being closest to or toward the feet of the upright wearer, etc.

In use, a wearer can install a plate in one of the front and or back panels 22, 24. Such plates are known, and can be various sizes, depending upon the desire of the user and/or the needs for a particular assignment. In embodiments disclosed herein, the plate retention system 70 is configured to securely mount plates of different sizes and anchor and/or center a plate in place in the pocket 76. To this end, the plate retention system 70 includes vertical aligning features for aligning a plate vertically in the pocket and horizontal aligning features for aligning a plate horizontally in the pocket 76. In combination, these features can align the plate in a desired position in the pocket 76, such as in the center and top of the pocket 76.

In some embodiments, the plate retention system 70 includes two sets of straps, one each at the lower bottom corners of the pocket 72. In short, these sets of straps include straps that are configured to extend around the bottom and sides of a plate inserted in the pocket and that attach to each other to push the plate to the center and top of the pocket 76. In this manner, the straps anchor the plate against the upper edge of the pocket, regardless of the size of the plate inserted. The straps can be any material, such as webbing, and include attachment mechanisms, such as hook and loop material, that permit attachment to each other at various locations along their length. Variable attachment locations permit anchoring of several different sizes of plates. The straps can be connected at different points along their length so that plates of various sizes can be accommodated. For each set, one strap extends under the plate (e.g., as a vertically aligning feature) and one strap extends around a bottom side edge of the plate (e.g., as a horizontally aligning feature). The ends are connected by the hook and loop materials to anchor the plate in the center of the pocket against the top of the pocket.

Specific embodiments are shown in FIGS. 8-11. A first strap 80 of each pair is positioned to extend horizontally, and is spaced from the bottom of the opening 72. The strap 80 is anchored at a first location 82 spaced inward from the side edge of the pocket and upward from a bottom edge of the pocket.

A second strap 84 of each pair is positioned to extend vertically, and is also anchored at a position spaced inward from the side edge of the pocket and upward from a bottom edge of the pocket. In embodiments, this second strap 84 is also anchored at the first location 82.

In embodiments, the first strap 80 is positioned so that, if any size plate that would typically be installed in the front panel 22 were installed in the pocket of the front panel and pushed fully upward against the top of the pocket, the bottom edge of the plate would extend below a bottom edge of the first strap 80. The length of the first strap 80 is preferably sufficient so that, if the widest plate that fits into the pocket were installed, the strap could double back along its length while extending around the outer edge of the plate. Thus, the first location 82 would fall behind any size plate installed in the pocket 76.

The second strap 84 is positioned in a similar manner relative to the bottom and sides of the pocket 76. In an embodiment where the two straps are anchored at the same location 82, the two locations for the two sets of straps are positioned to be located behind any size plate to be received in the pocket after the plate has been centered and pushed to the top of the pocket.

Figure 9:
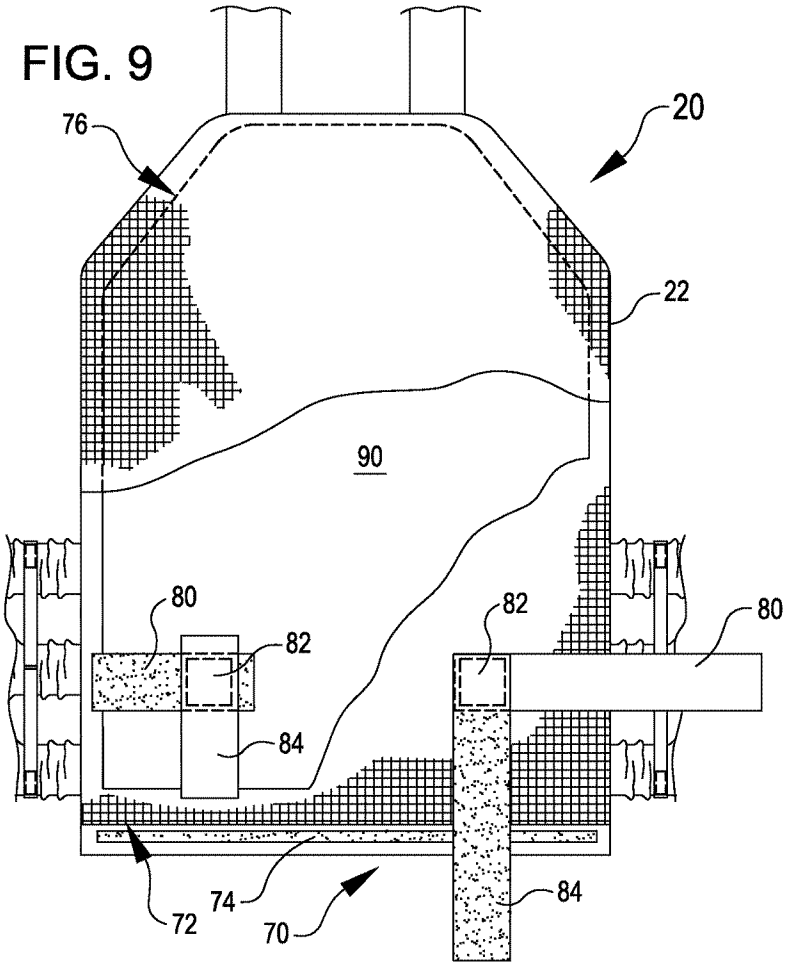
FIG. 9 is partial cutaway rear view of the front panel of the plate carrier vest of FIG. 8, with the plate carrier retention system partly detached.

To install a plate, such as the plate 90 shown in FIGS. 8 and 9, the fasteners 74 are opened at the bottom of the pocket 76 at the opening 72. The plate 90 is inserted into the pocket 76, centered in the pocket, and pressed upward against the top of the pocket. The ends of the two straps 80, 84 are wrapped around the side and bottom of the plate, respectively, and then attached to each other, for example via hook and loop fasteners extending along the length of the straps 80, 84. As an example, loop fastener material can be included on a front side of the strap 84, and hook fastener material on the rear side of the strap 80. The strap 80 is then folded over first, with the strap 84 attached to the strap 80. The straps 80, 84, if anchored at the same location 82, would be attached in the same vertical and horizontal position as the location 82 on the opposite side of the plate 90. If the straps are anchored at different locations, then the attachment would be varied based on the size of the plate.

Figure 11:
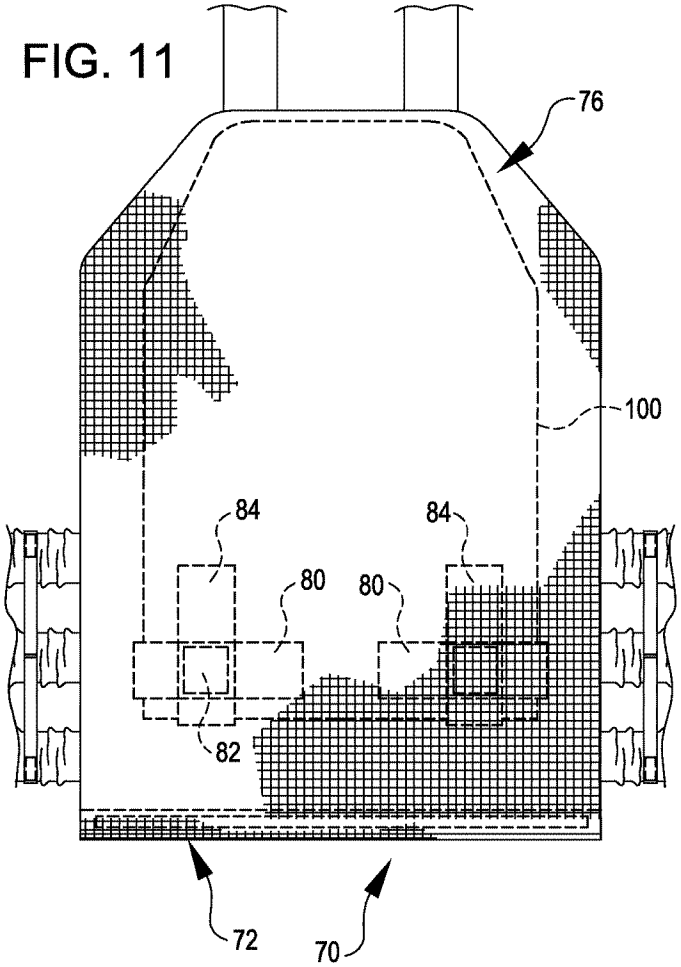
FIG. 11 is a rear view, similar to FIG. 8, with the plate of FIG. 10 mounted in the plate carrier vest.
Figure 10:
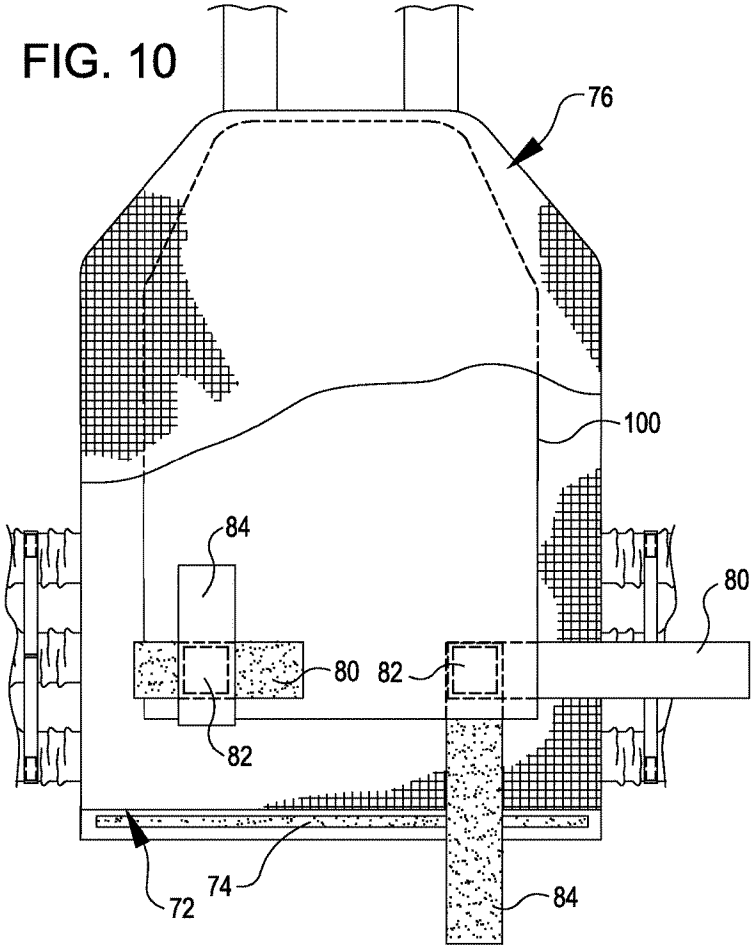
FIG. 10 is a partial cutaway rear view, similar to FIG. 9, with the plate carrier retention system partly attached around a smaller plate.

For a different size plate, such as the plate 100 shown in FIGS. 10-11, the straps are pulled more so as to appropriately anchor the plate. The system can thus be used on many different sized plates, and can be used to center the plate and position the plate upward. A plate could also be positioned to one side by varying the straps, for example to move the plate away from an injury. In addition, the plate does not have to be pushed to the top of the pocket, but instead could be held by gravity against the attached straps. Additionally, a similar strap configuration could be used at other locations in the pocket 76 (e.g., the top) to push the plate downward or in another desired direction.

In some embodiments, straps or other aligning features may be secured by being attached to a wall of the pocket in addition to—or in lieu of—attaching to one another. Such arrangements may secure the aligning features in a configuration that secures the plate in place, e.g., reducing a risk that straps may slip or shift during use and allow the plate to shift from a desired secured position. An example of such an arrangement is shown in FIGS. 12-13.

Figure 13:
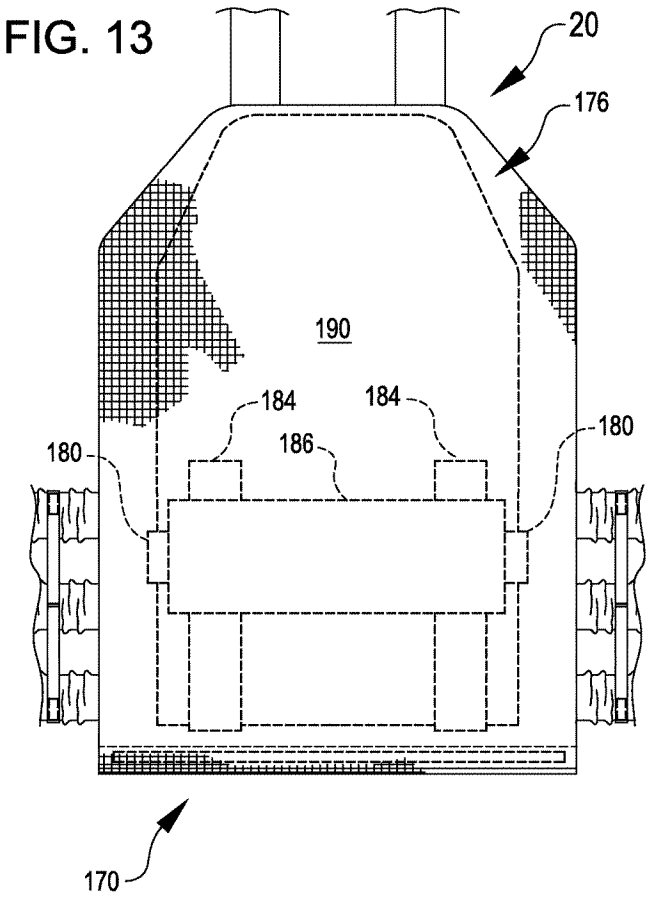
FIG. 13 is a front view of the front panel of the plate carrier vest of FIG. 12, with a plate mounted in the plate carrier vest.
Figure 12:
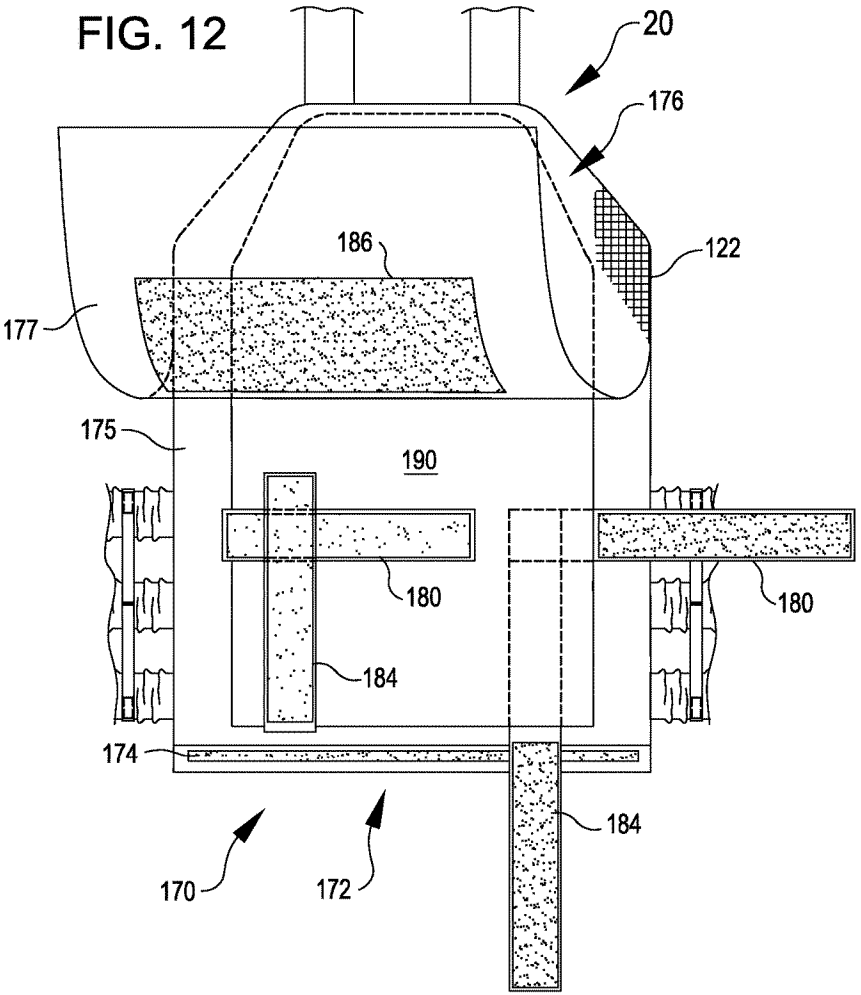
FIG. 12 is a front view of a front panel of a plate carrier vest with a pocket wall partly pulled away, showing another plate carrier retention system in accordance with embodiments.

FIGS. 12-13 illustrate another example of a plate retention system 170. Various features of the plate retention system 170 are similar to features with similar names and reference numbers described for the plate retention system 70 of FIGS. 8-11, and accordingly, relevant description of features will not be repeated.

The pocket 176 in the front panel 122 shown in FIG. 12 is formed with two opposite walls: an inner wall 175 (corresponding to the wall that—of the two opposite walls—is closer to the body of the wearer when the vest 20 is worn) and an outer wall 177 (corresponding to the wall that—of the opposite two walls—is further from the body of the wearer when the vest 20 is worn). To more readily show details within the pocket 176, the outer wall 177 is shown pulled away from the inner wall 175 in FIG. 12. However, in use, the opposite walls 175 and 177 are typically joined along multiple edges, e.g., so that the walls 175 and 177 are only readily separable along the opening 172 and/or closure 174. The straps 180, 184 of the plate retention system 170 are each shown anchored to the inner wall 175. The straps 180, 184 can be folded around edges of the plate 190 by variable amounts to align the plate 190 as desired within the pocket 176. A secondary fastener is included for attachment of the straps 180, 184 in this folded arrangement to the outer wall 177. For example, this secondary fastener may include a patch 186 of hook fastener material or loop fastener material that is mounted on the outer wall 177 and that can attach to corresponding material on any or all of the straps 180, 184.

In the specific embodiment illustrated in FIG. 12, each strap 180, 184 includes hook fastener material on one side and loop fastener material on an opposite side. The straps 180, 184 are shown arranged so that the hook fastener material is on the rear sides of the straps 180, 184, e.g., on the sides visible on the left of FIG. 12 (which are the sides that face the walls 175, 177 of the pocket 176 when the straps 180, 184 are folded about the plate 190). On the other hand, the loop fastener material is shown on the front sides of the straps 180, 184, e.g., on the sides visible on the right of FIG. 12 (which are the sides that face the plate 190 when the straps 180, 184 are folded about the plate 190). This arrangement can allow the straps 180, 184 to be folded over the plate 190 in any order and still attach to one another. For example, although the straps 180, 184 are shown on the left side of FIG. 12 with the sideways strap 180 folded over first and the downward strap 184 folded over second (i.e., so that the loop fastener material on the front of the downward strap 184 attaches to the hook fastener material on the rear of the sideways strap 180), this order could be changed to fold the downward strap 184 first and the sideways strap 180 second (i.e., so that the loop fastener material on the front of the sideways strap 180 attaches to the hook fastener material on the rear of the downward strap 184). Additionally, the sideways straps 180 may be folded over each other in any order (e.g., right over left, or left over right) so that the loop fastener material on the front of one attaches to the hook fastener material on the rear of the other.

The patch 186 can be brought into contact against the straps 180, 184 to secure the straps 180, 184 in place. For example, a user may hold the outer wall 177 apart from the inner wall 175 at the opening 172, fold the straps 180, 184 over the plate 190 to align the plate 190 within the pocket 176, and press the outer wall 177 toward the inner wall 175 to bring the patch 186 into contact with the straps 180, 184. In the embodiment shown in FIG. 12, the patch 186 is a patch of loop fastener material that engages the hook fastener material that is exposed on the rear of the straps 180, 184 that have been folded over the plate 190. In this manner, the patch 186 can secure the straps 180, 184 to the outer wall 177 in a configuration in which the straps 180, 184 are folded or doubled over the plate 190 in the pocket 176, such as illustrated in FIG. 13.

In some embodiments, connection to the outer wall 177 via the patch 186 may reinforce the connections made among the straps 180, 184. For example, the patch 186 may engage straps 180, 184 that have already been attached to one another, as described above. In other embodiments, the patch 186 may provide the sole attachment mechanism for holding the straps 180, 184 in a folded state. For example, if the loop fastener material on the front of the straps 180, 184 in FIG. 12 is omitted, the loop fastener material shown on the patch 186 may engage the hook fastener material shown on the rear of the straps 180, 184 when folded to hold the straps 180, 184 in place. As another example, the patch 186 may be sized to individually engage the straps 180, 184 even if some or all of the straps 180, 184 are not long enough to reach around a particular plate 190 to reach or cross one another.

Additionally, although the straps 180, 184 are shown in FIG. 12 with hook fastener material on a rear side and loop fastener material on a front side, other hook and loop arrangements are possible. For example, the arrangement shown in FIG. 12 could be reversed so that the patch 186 and the front side of the straps 180, 184 have hook fastener material while the rear sides of the straps 180, 184 have loop fastener material. As another example, the vertical straps 184 may include hook fastener material on both sides, such as to act as an adaptor for attaching loop fastener material on the rear side of the horizontal straps 180 to loop fastener material on the patch 186. While some alternate arrangements may have benefits such as reducing a total amount of fastener material utilized, there may also be corresponding disadvantages such as limiting an order in which straps 180, 184 can be folded to secure to one another or increasing an amount of surface area exposed to possible wear or damage from an increased amount of hook fastener material.

Figure 15:
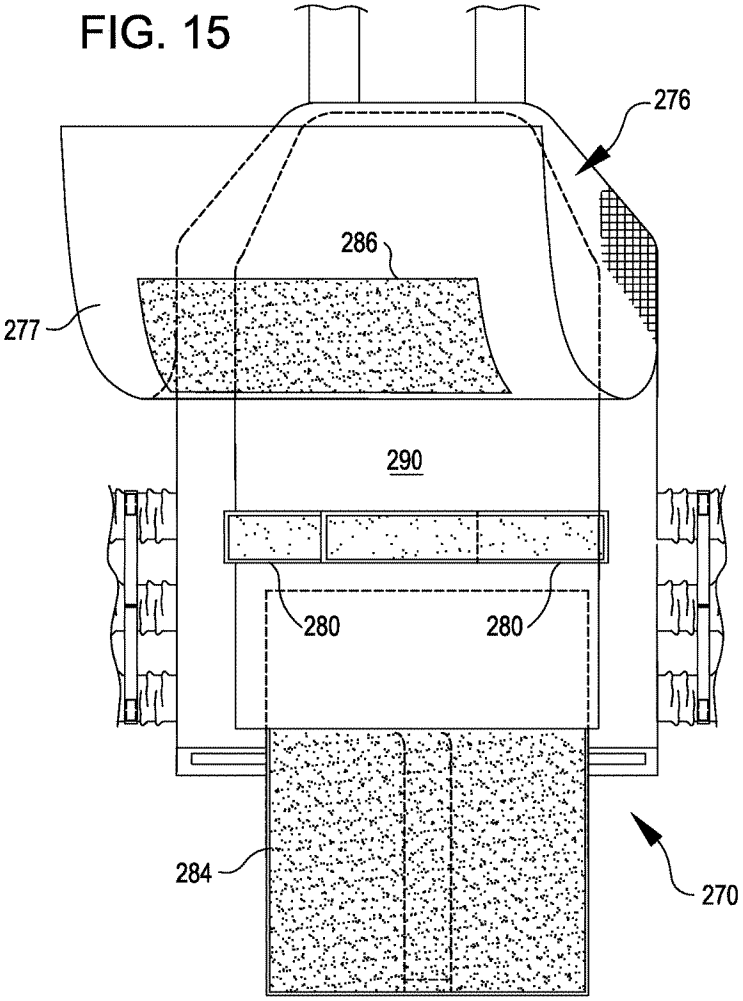
FIG. 15 is a front view of the front panel of the plate carrier vest of FIG. 14, showing horizontally aligning features folded over the plate.
Figure 14:
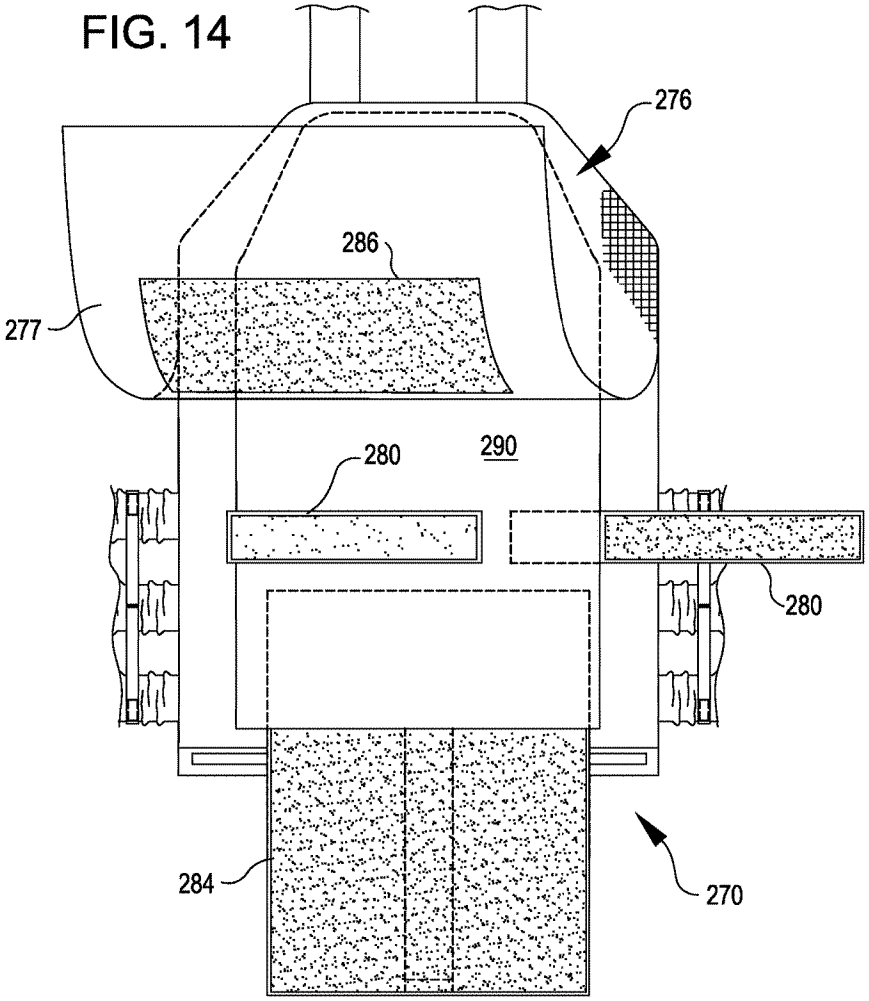
FIG. 14 is a front view of a front panel of a plate carrier vest, showing yet another plate carrier retention system in accordance with embodiments.
Figure 16:
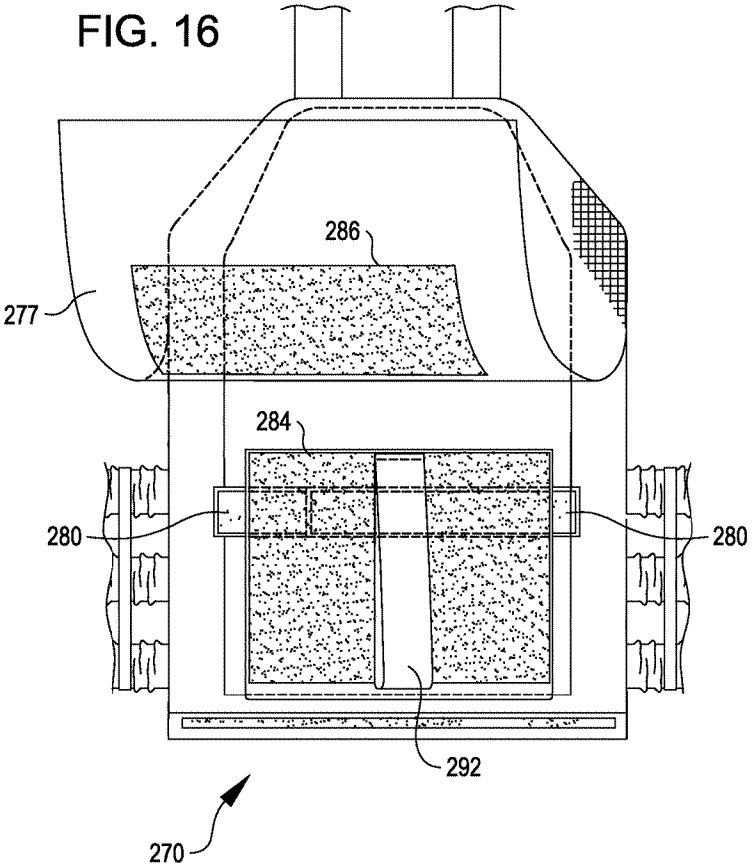
FIG. 16 is a front view of the front panel of the plate carrier vest of FIGS. 14-15, further showing a vertically-aligning feature folded over the plate.

FIGS. 14-16 illustrate yet another example of a plate retention system 270. Various features of the plate retention system 270 are similar to features with similar names and reference numbers described for the plate retention system 70 of FIGS. 8-11 and/or the plate retention system 170 of FIGS. 12-13, and accordingly, relevant description of features will not be repeated.

The plate retention system 270 utilizes a single flap 284 as a vertical aligning feature and two straps 280 as horizontally-aligning features. The single flap 284 may be webbing or any other material. The flap 284 may represent an extra wide strap, e.g., with a width that is greater than a width of either of the horizontal straps 280 and/or that extends at least between locations at which the horizontal straps 280 are anchored to an inner wall 275 of the pocket 276. In the embodiment illustrated in FIGS. 14-16, the flap 284 is substantially covered on a rear side with hook fastener material and on a front side with loop fastener material. However, in some embodiments, such covering or larger panels may be replaced by strips of hook and/or loop fastener material, such as along edges of the flap 284.

In operation, a user may horizontally align the plate 290 within the pocket 276 by folding the horizontal straps 280 by appropriate amounts (e.g., FIG. 15). The horizontal straps 280 can be secured in this aligning position by any attachment mechanism, including by attaching to one another (e.g., via hook and loop fastener material on opposite sides of the horizontal straps 280), by attachment to the flap 284 (e.g., via hook and loop fastener material on the horizontal straps 280 and on the flap 284), by attachment to the patch 286 on the outer wall 277 (e.g., via hook and loop fastener material on the horizontal straps 280 and on the patch 286), or any combination thereof. The user may also vertically align the plate 290 within the pocket 276 by folding the flap 284 by an appropriate amounts (e.g., FIG. 16). In various embodiments, the user may fold the flap 284 and the horizontal straps 280 in any order, e.g., due to alternating arrangements of hook and loop fastener material on the various folding members. The flap 284 can also include a handle 292, such as made of a loop of webbing. The handle 292 may provide a place for a user to grip for applying sufficient force to separate large amounts of engaged hook and loop fastener material, such as on the front and/or rear of the flap 284 when engaged with the patch 286 and/or the horizontal straps 280. In some embodiments, the flap 284 can be folded over the plate 290 first, and the horizontal straps 280 can be routed through the handle 292 to further secure the flap 284 and/or the horizontal straps 280 within the pocket 276.

The plate retention systems described herein can also be subject to other variations. For example, although certain features may have been described in relationship to one of the walls (e.g., straps mounted to an inner wall and a patch mounted on the outer wall for receiving the straps), relationships with the walls may be reversed or otherwise altered (e.g., having the straps mounted to the outer wall and a patch on the inner wall for receiving the straps). Also, although horizontal straps are generally shown as two separate straps formed from two different pieces of webbing each attached to an inner wall, in some embodiments, the horizontal straps may correspond to opposite ends of a single piece of webbing or other material (e.g., attached at anchor points such as the first location 82 described with respect to FIGS. 8-11). Furthermore, although fasteners are primarily described as hook and loop fasteners herein, other forms of fasteners may be used to provide variable attachment locations, including, but not limited to, snaps, magnets, or buttons.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein, including cited in the contemporaneously filed Information Disclosure Statement, are hereby incorporated by reference to the same extent as if each reference were individually and specifically indicated to be incorporated by reference and were set forth in its entirety herein.

What is claimed is:

1. A plate retention system, comprising:

a carrier configured to be worn on a body of a wearer;

a pocket for removably receiving a ballistic plate, the pocket coupled with the carrier and configured to be located along the body of the wearer when the carrier is worn by the wearer, the pocket having a vertical direction configured to be aligned with a direction of gravity when the carrier is worn by the wearer when the wearer is in an upright position; the pocket having a horizontal direction transverse to the vertical direction; and an inside of the pocket being formed at least in part by a first wall and a second wall facing one another, the first wall and the second wall joined along multiple edges and defining an opening configured to provide access into the inside of the pocket;

a horizontally-aligning feature comprising a first horizontal strap and a second horizontal strap anchored to the first wall within the pocket and aligned to extend along the horizontal direction in the pocket, the first and second horizontal straps sized to be folded over opposite side edges of the ballistic plate by variable amounts to adjust a horizontal alignment of the ballistic plate within the pocket when the ballistic plate is received within the pocket;

a vertically-aligning feature comprising a vertical strap anchored to the first wall within the pocket and aligned to extend along the vertical direction in the pocket, the vertical strap sized to be folded over a bottom edge of the ballistic plate by variable amounts to adjust a vertical alignment of the ballistic plate within the pocket when the ballistic plate is received within the pocket;

a patch on the second wall within the pocket and facing the first wall;

each strap of the horizontally-aligning feature and of the vertically-aligning feature comprising (i) a first side corresponding to a side facing the ballistic plate when the strap is folded over the ballistic plate when the ballistic plate is received within the pocket, and (ii) a second side corresponding to a side facing the second wall when the strap is folded over the ballistic plate when the ballistic plate is received within the pocket; and hook fastener material and loop fastener material arranged in an arrangement in which the patch and the first side of each strap comprise one of the hook fastener material or the loop fastener material and in which the second side of each strap comprises an opposite of said one of the hook fastener material or the loop fastener material, whereby each strap of the horizontally-aligning feature and of the vertically-aligning feature are attachable by the hook and loop fastener material to the patch directly or through one or more other of the straps so as to secure the straps in an arrangement in which the straps of the horizontally-aligning feature are folded about the side edges of the ballistic plate and the straps of the vertically-aligning feature are folded about the bottom edge of the ballistic plate for at least one of supporting the ballistic plate when received in the pocket or maintaining an alignment of the ballistic plate when received in the pocket.

2. The plate retention system of claim 1, wherein the vertically-aligning feature comprises a first vertical strap and a second vertical strap.

3. The plate retention system of claim 1, wherein the vertical strap of the vertically-aligning feature comprises a flap having a width greater than a width of the first horizontal strap.

4. The plate retention system of claim 1, further comprising the ballistic plate.

5. A plate retention system, comprising:

a carrier configured to be worn on a body of a wearer; a pocket for removably receiving a plate having a lower left corner and a lower right corner, the pocket coupled with the carrier and configured to be located along the body of the wearer when the carrier is worn by the wearer, the pocket comprising:

a first wall;

a second wall facing the first wall, the first wall and the second wall joined along multiple edges and defining an opening configured to provide access into an inside of the pocket defined between the first wall and the second wall;

a first strap set anchored within the pocket and configured for supporting the lower right corner of the plate within the pocket; and a second strap set anchored within the pocket and configured for supporting the lower left corner of the plate within the pocket, wherein the first and second strap sets each comprise:

a first strap anchored within the pocket and aligned to extend sideways in the pocket; and a second strap anchored within the pocket and aligned to extend downward in the pocket, the first and second straps comprising fasteners for attaching the straps and supporting and centering the plate within the pocket;

wherein the first strap set and the second strap set are anchored to the first wall, the plate retention system further comprising secondary fasteners for releasably attaching at least one strap from at least one of the first strap set or the second strap set to the second wall.

6. The plate retention system of claim 5, wherein the fasteners comprise hook and loop fasteners.

7. The plate retention system of claim 5, wherein the first and second straps for each strap set is anchored in a single location.

8. The plate retention system of claim 5, wherein the secondary fasteners comprise hook and loop fasteners.

9. The plate retention system of claim 5, further comprising the plate.

10. A plate retention system, comprising:

a carrier configured to be worn on a body of a wearer;

a pocket for removably receiving a plate, the pocket comprising a first wall and a second wall facing the first wall, the first wall and the second wall joined along multiple edges and defining an opening configured to provide access into an inside of the pocket defined between the first wall and the second wall, the pocket coupled with the carrier and configured to be located along the body of the wearer when the carrier is worn by the wearer, the pocket having a vertical direction configured to be aligned with a direction of gravity when the carrier is worn by the wearer when the wearer is in an upright position, and the pocket having a horizontal direction transverse to the vertical direction;

a horizontally-aligning feature comprising a horizontal strap anchored to the first wall within the pocket and aligned to extend along the horizontal direction in the pocket, the horizontal strap sized to be folded over a side edge of the plate by variable amounts to adjust a horizontal alignment of the plate within the pocket when the plate is received within the pocket;

a vertically-aligning feature comprising a vertical strap anchored to the first wall within the pocket and aligned to extend along the vertical direction in the pocket, the vertical strap sized to be folded over a bottom edge of the plate by variable amounts to adjust a vertical alignment of the plate within the pocket when the plate is received within the pocket;

at least one fastener for releasably securing the horizontally-aligning feature in an arrangement folded over the side edge of the plate and for releasably securing the vertically-aligning feature in an arrangement folded over the bottom edge of the plate when the plate is received within the pocket, wherein the at least one fastener is operable to releasably attach at least one of the horizontally-aligning feature or the vertically-aligning feature to the second wall;

a first strap set for supporting a lower right corner of the plate within the pocket; and a second strap set for supporting a lower left corner of the plate within the pocket;

wherein the first and second strap sets each comprise at least one strap of the horizontally-aligning feature and at least one strap of the vertically-aligning feature.

11. The plate retention system of claim 10, wherein the at least one fastener comprises hook and loop fasteners.

12. The plate retention system of claim 10, wherein the vertical strap of the vertically-aligning feature comprises a flap having a width that is greater than a width of the horizontal strap.

13. The plate retention system of claim 10, wherein the vertically-aligning feature comprises a first vertical strap and a second vertical strap.

14. The plate retention system of claim 10, wherein the horizontal strap comprises a first horizontal strap and the horizontally-aligning feature further comprises a second horizontal strap, wherein the first horizontal strap and the second horizontal strap are arranged to be folded over opposite side edges of the plate.

15. The plate retention system of claim 14, wherein the at least one fastener is operable to releasably attach the first and second horizontal straps to one another.

16. The plate retention system of claim 10, wherein the at least one fastener is operable to releasably attach the horizontally-aligning feature with the vertically-aligning feature.

17. The plate retention system of claim 10, wherein the at least one fastener comprises a plurality of fasteners located on one or more of the horizontally-aligning feature, the vertically-aligning feature, or the second wall of the pocket.

18. The plate retention system of claim 10, wherein the plate comprises a ballistic plate;

wherein the horizontal strap comprises a first horizontal strap and the horizontally-aligning feature further comprises a second horizontal strap anchored to the first wall and aligned to extend along the horizontal direction in the pocket, the first and second horizontal straps sized to be folded over opposite side edges of the ballistic plate by variable amounts to adjust a horizontal alignment of the ballistic plate within the pocket when the ballistic plate is received within the pocket;

wherein the vertical strap is anchored to the first wall within the pocket;

wherein the plate retention system further comprises a patch on the second wall of the pocket;

wherein each strap of the horizontally-aligning feature and of the vertically-aligning feature comprises a first side corresponding to a side facing the ballistic plate when the strap is folded over the ballistic plate when the ballistic plate is received within the pocket, and (ii) a second side corresponding to a side facing the second wall when the strap is folded over the ballistic plate when the ballistic plate is received within the pocket;

wherein the at least one fastener comprises hook fastener material and loop fastener material arranged in an arrangement in which the patch and the first side of each strap comprise one of the hook fastener material or the loop fastener material and in which the second side of each strap comprises an opposite of said one of the hook fastener material or the loop fastener material, whereby each strap of the horizontally-aligning feature and of the vertically-aligning feature are attachable by the hook and loop fastener material to the patch directly or through one or more other of the straps so as to secure the straps in an arrangement in which the straps of the horizontally-aligning feature are folded about the side edges of the ballistic plate and the straps of the vertically-aligning feature are folded about the bottom edge of the ballistic plate for at least one of supporting the ballistic plate when received in the pocket or maintaining an alignment of the ballistic plate when received in the pocket.

19. The plate retention system of claim 10, further comprising the plate.

* * * * *